US007778390B2

(12) United States Patent
Schliermann

(10) Patent No.: US 7,778,390 B2
(45) Date of Patent: Aug. 17, 2010

(54) X-RAY FACILITY WITH ERROR PROTECTION CIRCUIT

(75) Inventor: Claus-Günter Schliermann, Kemnath (DE)

(73) Assignee: Siemens Aktiengesellschaft (DE)

( * ) Notice: Subject to any disclaimer, the term of this patent is extended or adjusted under 35 U.S.C. 154(b) by 85 days.

(21) Appl. No.: 11/795,168

(22) PCT Filed: Jan. 10, 2006

(86) PCT No.: PCT/EP2006/050128

§ 371 (c)(1),
(2), (4) Date: Jul. 12, 2007

(87) PCT Pub. No.: WO2006/077186

PCT Pub. Date: Jul. 27, 2006

(65) Prior Publication Data

US 2008/0118029 A1 May 22, 2008

(30) Foreign Application Priority Data

Jan. 19, 2005 (DE) ..... 10 2005 002 559

(51) Int. Cl.
*H05G 1/56* (2006.01)

(52) U.S. Cl. ..... 378/115; 378/116

(58) Field of Classification Search ..... 378/114–117
See application file for complete search history.

(56) References Cited

U.S. PATENT DOCUMENTS 3,863,073 A 1/1975 Wagner
6,940,948 B1 * 9/2005 Tretiakov et al. ..... 378/146
6,999,558 B2 * 2/2006 Okoda ..... 378/102
2003/0194056 A1 * 10/2003 Spahn ..... 378/205

FOREIGN PATENT DOCUMENTS

DE 200 13 478 U1 11/2000

OTHER PUBLICATIONS

International Search Report dated Sep. 19, 2006.
Dr. Eder."Erhöhte Strahlenexposition infolge gerätebedingter Störfälle," gefunden May 21, 2001, Bayerischen Landesamtes für Gesundheit und Lebensmittelsicherheit (LGL) XP 002390561.
"Polydoros LX 30/LX 50/LX 80, Polydoros LX 30 Lite /LX 50 Lite, Polydoros SX 65/SX 80, Multipuls-Generatoren," Siemens AG undated paper, pp. 1-10.

(Continued)

*Primary Examiner*—Hoon Song
(74) *Attorney, Agent, or Firm*—Brinks Hofer Gilson & Lione

(57) ABSTRACT

The invention relates to a residual-current circuit breaker for an X-ray device. In one embodiment, the residual-current circuit breaker comprises at least one input, via which a detector identification signal of a detector identification element can be received, said signal characterizing the presence of an X-ray detector and at least one input, via which a selection signal for an exposure measurement element can be received, said signal characterizing the activation of an exposure measurement element. A deactivation signal can be issued via at least one output of the residual-current breaker, the deactivation signal being generated as long as a detector identification signal and a selection signal that is assigned to the same detector as the detector identification signal are not received at the same time.

11 Claims, 3 Drawing Sheets

OTHER PUBLICATIONS

"Gebrauchsanweisung Polydoros LX 80 mit Touchscreen," Siemens AG 1998 paper, 33 pages.

Siemsn Anlagen-Gebrauchsanweisung, "MULTIX TOP," Siemens AG 1998 paper, 100 pages.

* cited by examiner

X-RAY FACILITY WITH ERROR PROTECTION CIRCUIT

The present patent document is a nationalization of PCT Application Serial Number PCT/EP2006/050128, filed Jan. 10, 2006, designating the United States, which is hereby incorporated by reference. The present patent document also claims the benefit of DE 10 2005 002 559.5, filed Jan. 19, 2005.

BACKGROUND

The present embodiments relate to an error protection circuit for an x-ray facility and an x-ray facility with such an error protection circuit. Error protection circuits prevent the emission of high radiation doses due to operating errors.

X-ray facilities have at least one image receiver. The image receiver records x-ray images of a patient or body to be examined, which is fluoroscopically examined by the x-ray radiation of an x-ray emitter. The image receiver has a cassette drawer in the case of cassette recording points. A cassette-type x-ray detector is inserted in the cassette drawer. The x-ray detector can, for example, be an x-ray film cassette. The cassette drawer also has an exposure measurement chamber, which is used to set automatic exposure times. The exposure measurement chamber measures the radiation dose occurring at the x-ray detector and triggers a disconnect signal for the x-ray emitter when a predetermined measurement value is reached.

Cassette drawers and other image receivers can be disposed, for example, on patient support tables, on C-arms, floor gantries or ceiling gantries. Further possibilities for the arrangement of image receivers are conceivable. Depending on which x-ray recording points are to be realized, x-ray facilities have one or more image receivers. To produce an x-ray recording, an x-ray detector has to be inserted into the respective image receiver and the x-ray emitter has to be oriented toward the image receiver.

Operator errors can occur because an x-ray detector does not have to be inserted into every image receiver and it does not have to be possible to identify from outside whether an x-ray detector is inserted. The x-ray emitter can be switched on, even though there is no x-ray detector inserted into the corresponding image receiver. The radiation dose administered to the patient is a pointless load on the examined patient or body, since no x-ray recording can be produced without an x-ray detector.

X-ray facilities with a number of image receivers require inserting the x-ray detector and activating an exposure measurement chamber assigned to the x-ray detector. It is possible that an x-ray detector is inserted into the correct image receiver but the exposure measurement chamber assigned to the x-ray detector has not been activated. Possibly an operator erroneously selects the wrong image receiver, even though they have inserted the x-ray detector into the correct image receiver. If an x-ray recording is then initiated using an automatic exposure unit, very high radiation exposure results and the erroneously selected exposure measurement chamber does not receive any x-ray radiation. The x-ray radiation strikes the exposure measurement chamber of the correct but not selected image receiver. If the selected exposure measurement chamber does not receive a radiation dose however, it also does not generate a disconnect signal for the x-ray emitter, since the dose limit value is not reached.

To avoid unnecessary radiation exposure due to such operating errors, the exposure measurement chamber signal can be observed while the x-ray recording is being produced. If after a predetermined time the measurement chamber signal is below a minimum value, incorrect operation is assumed and the x-ray recording is aborted. However, modern image receivers are so sensitive that the predetermined minimum value has to be set extremely low. The minimum value is exceeded simply by the scattered radiation occurring at the exposure measurement chamber and the x-ray recording is therefore not aborted.

In the case of x-ray facilities with a central device controller, the production of an x-ray recording is only initiated when an x-ray detector is inserted in the selected image receiver. It is only necessary to provide a detector identification, identifying the presence of an x-ray detector, in the image receiver. However, simple, manual x-ray facilities generally do not have a central controller.

DE 200 13 478 U1 discloses a solution for checking whether an x-ray detector is inserted in the image receiver and whether the grid contact of the image receiver is closed. A grid contact is used with image receivers, which have a moving scattered radiation grid. The solution disclosed in DE 200 13 478 U1 is not suitable for image receivers without or with a fixed scattered radiation grid.

SUMMARY

The present embodiments may obviate one or more of drawbacks or limitations of the prior art. For example, one of the present embodiments prevents high radiation exposures due to operating errors in a manner that is as economical as possible and can be used in many different ways.

In one embodiment, an error protection circuit includes at least one input, by way of which a detector identification signal of a detector identification element can be received. The detector identification signal characterizing the presence of an x-ray detector. At least one input, by way of which a selection signal for an exposure measurement element can be received. The selection signal characterizing the activation of an exposure measurement element. At least one output, by way of which a deactivation signal can be emitted. The deactivation signal generated as a function of receipt of a detector identification signal and a selection signal assigned to the same detector as the detector identification signal. The selection signal indicates which image receiver has been selected, while the detector identification signal indicates whether an x-ray detector has actually been inserted in the selected image receiver.

The error protection circuit prevents an error situation, in which someone has forgotten to insert a detector. The error protection circuit reliably identifies an error situation, in which an x-ray detector has been inserted into the correct image receiver, but the wrong image receiver has been activated. A signal that is available anyway in the x-ray facility is used with the selection signal for the exposure measurement element as the signal for identifying which image receiver is to be used. No other modification of the x-ray facility is required for this. The signal of a detector identification element is used as the signal for identifying whether an x-ray detector is inserted. If the image receiver does not make such a signal available anyway, a corresponding sensor or contact can be realized with little outlay.

The error protection system has a logic or logical circuit, which links the detector identification signal to the selection signal, to form the deactivation signal. The logical link includes linking the detector identification signal and the selection signal for the same image receiver, such that a deactivation signal is generated, if both input signals are not positive. The deactivation signal can be used by the x-ray facility to prohibit the generation of x-ray radiation.

In one embodiment, the deactivation signal is generated if a detector identification signal is received but the selection signal assigned to the same detector as the detector identification signal is not received. This deactivation signal status indicates that an x-ray detector is inserted but the wrong image receiver has been selected.

In one embodiment, the deactivation signal is generated if a selection signal is received but the detector identification signal assigned to the same detector as the selection signal is not received. This deactivation signal status indicates that the right image receiver was selected but someone forgot to insert an x-ray detector.

In one embodiment, the deactivation signal is received by an x-ray generator. The error protection circuit can prohibit the production of an x-ray recording by preventing the x-ray generator applying an x-ray voltage to the x-ray emitter. This prevents the generation of x-ray radiation in a direct manner without involving error-prone means.

In one embodiment, the deactivation signal is received by way of an input of the x-ray generator provided for deactivation signals, for example, for contact signals. The error protection circuit only has to be connected to an input of the x-ray generator, which is generally present anyway. The input for a door contact signal is generally present, to prevent the initiation of x-ray recordings while the door to the control space containing the x-ray controller is not closed. This protects operators from unnecessary radiation exposure. No modification of the x-ray generator is required because inputs of the x-ray generator that are present are utilized. This makes it possible, for example, to retrofit the error protection circuit easily in already installed x-ray facilities.

In one concept, an x-ray facility with at least one image receiver includes at least one detector identification element. A detector identification signal can be generated by the at least one detector identification element. The detector identification signal characterizes the presence of an x-ray detector. The x-ray facility includes at least one exposure measurement element, which can be activated by a selection signal generated by the x-ray facility. The x-ray facility includes an error protection circuit as described above.

DETAILED DESCRIPTION

Figure 1:
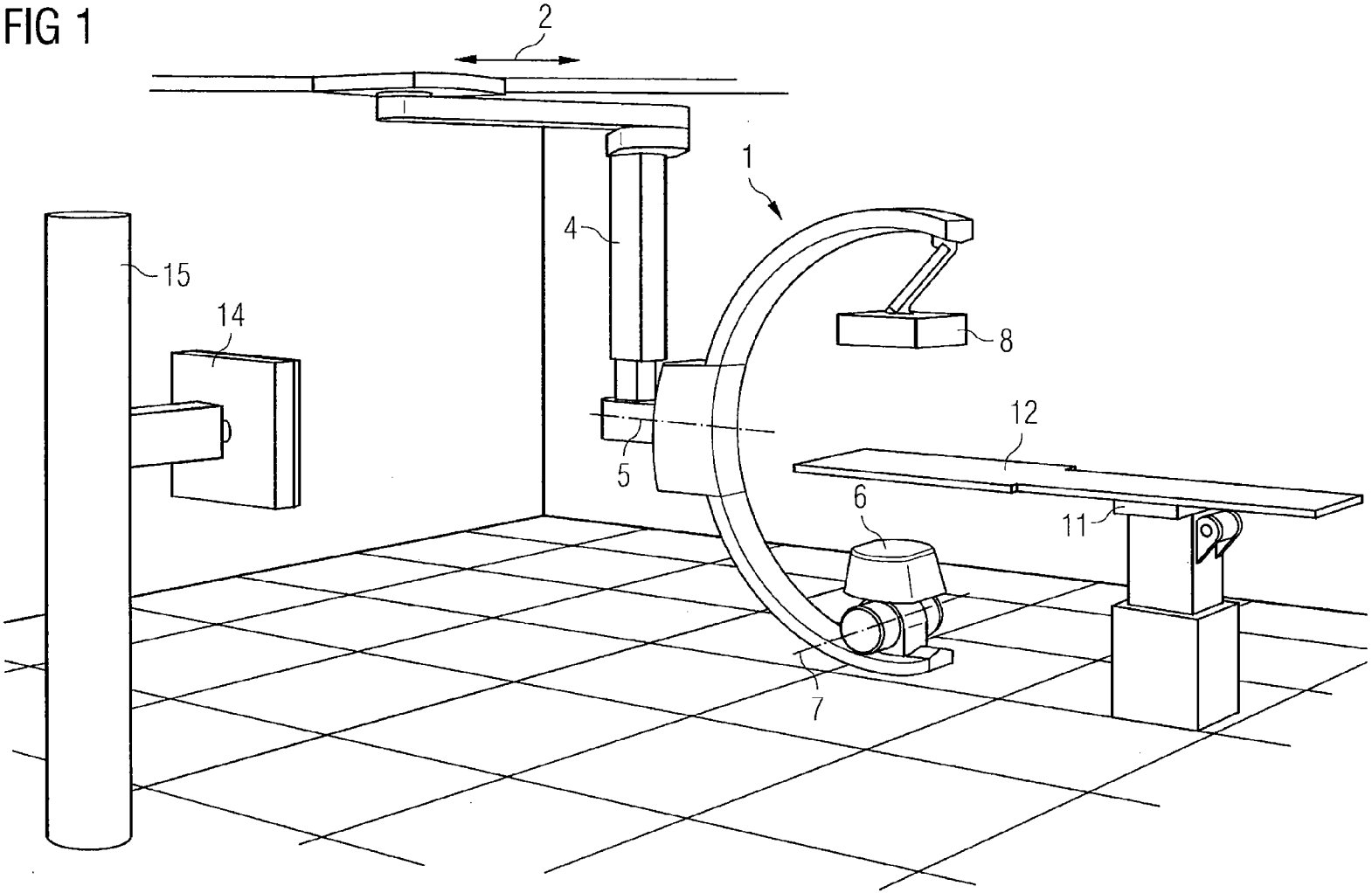
FIG. 1 illustrates an x-ray facility with a number of image receivers.

FIG. 1 illustrates an x-ray facility, by means of which different x-ray recording points can be realized. An x-ray recording point here refers to a specific body position of the patient to be examined with associated orientation of the x-ray emitter and image receiver.

In one embodiment, as shown in FIG. 1, the x-ray facility has an x-ray emitter 6, which is supported in a C-arm 1 so that it can be rotated about a horizontal axis 7. An image receiver 8 is supported in the C-arm 1.

The C-arm 1 is supported in a ceiling gantry 4 so that it can be rotated about a horizontal axis 5. The ceiling gantry 4 has possibilities for vertical displacement, rotation, and horizontal travel. The horizontal travel is illustrated by a double arrow 2.

The x-ray facility includes a patient bed 12, supported on a base standing on the floor of the examination room. An image receiver 11 is disposed below the patient bed 12. The image receiver 11 is a cassette drawer, which can be pulled out in the manner of a conventional drawer below the patient bed 11, to insert or remove an x-ray detector, for example. To utilize an x-ray recording point using the image receiver 11, the C-arm 1 is oriented so that the x-ray emitter 6 is oriented toward the image receiver 11.

The x-ray facility includes a floor gantry 15. The floor gantry 15 holds an image receiver 14. The image receiver 14 produces x-ray recordings at the standing patient, to which end the x-ray emitter 6 is also correspondingly oriented.

To produce an x-ray recording, an operator must position the patient, insert an x-ray detector into the required image receiver 8, 11, 14 and activate the image receiver 8, 11, 14, by selecting the respective exposure measurement chamber.

Figure 2:
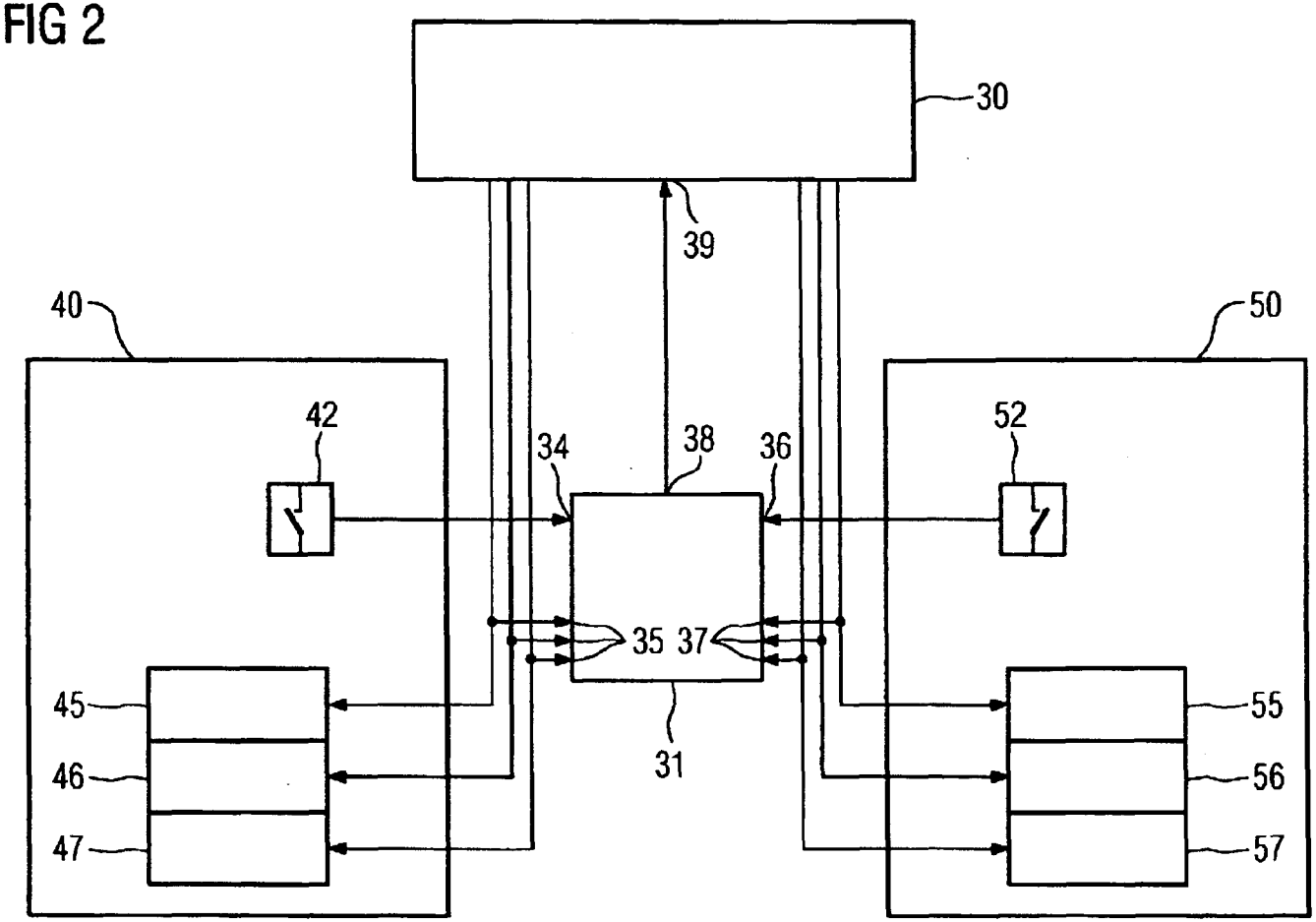
FIG. 2 illustrates an x-ray generator with image receivers and an error protection circuit.

In one embodiment, as shown in FIG. 2, an x-ray generator 30 includes an error protection circuit 31 and image receivers 40, 50. In FIG. 2, the corresponding signal connections are symbolized by arrow lines. The x-ray generator 30 includes an input 39 for a deactivation signal. If the x-ray generator 30 receives a positive deactivation signal by way of the input 39, generation of an x-ray voltage is prohibited. Prohibiting the generation of x-ray voltage, as required to operate an x-ray emitter, directly prevents the generation of x-ray radiation. The input 39 can, for example, be the signal input for a door contact.

The image receivers 40, 50 include detector detection elements 42, 52, to identify the respective presence of an x-ray detector. The detector detection elements 42, 52 generate a positive signal, if an x-ray detector is inserted. The detector detection elements 42 emit this signal to corresponding inputs 34, 36 of the error protection circuit 31.

The image receivers 40, 50 also include exposure measurement elements with measurement fields 45, 46, 47, 55, 56, 57. The exposure measurement elements or their measurement fields are activated by a respective selection signal, which is generated by the x-ray generator 30. The respective selection signal activates at least one measurement field 45, 46, 47, 55, 56, 57 of the image receiver 40, 50, which is to be used to produce an x-ray recording. The selection signal goes to the error protection circuit 31 and to the image receivers 40, 50 by way of corresponding inputs 35, 37.

The error protection circuit 31 has a logic, which links the input signals to the inputs 34, 35, 36, 37 as described below.

If the presence of a cassette in the image receiver 40 is detected by the detector detection element 42, at least one of the exposure measurement elements 45, 46, 47 must be selected at the same time, so that no deactivation signal is generated. The selection signals for the exposure measurement elements 45, 46, 47 are therefore OR-linked. The result of the OR operation is AND-linked to the signal of the detector detection element 42. The result of the AND linking operation is inverted, to obtain the deactivation signal. A positive signal indicates that the x-ray detector is present, and an exposure measurement element is selected and respectively the deactivation signal is active. It would be possible to invert the significance of the respective signal, and this would have to be taken into account by a corresponding change to the described logical linking operations. Corresponding changes, however, result from the effect of the described logic, so are not described in more detail here.

If neither a signal of the detector detection element 42 nor a signal of one of the exposure measurement elements 45, 46, 47 is generated in the image receiver 40, the described logical linking of the signals similarly leads to the generation of the deactivation signal.

The signals of the image receiver 50 are linked in the same manner as the signals of the image receiver 40.

Based on a linking of the logical signals, obtained from the individual signals of both image receivers 40, 50, it is possible to identify further incorrect operation situations. If the signal status of both image receivers 40, 50 results in the generation of the deactivation signal, this should actually be generated. If however the signal status of both image receivers 40, 50 results respectively in the suppression of the deactivation signal, it is assumed that both image receivers 40, 50 have been selected and an x-ray detector has been inserted erroneously in each instance. The simultaneous use of both image receivers 40, 50 can however in principle be excluded, since an x-ray emitter can only be oriented toward one of the image receivers. To prevent this incorrect operation situation, the signals for the two image receivers 40, 50 are OR-linked and then inverted. As a result of this linking operation the deactivation signal is only suppressed, if just one image receiver 40, 50 is selected and an x-ray detector is inserted.

Figure 3:
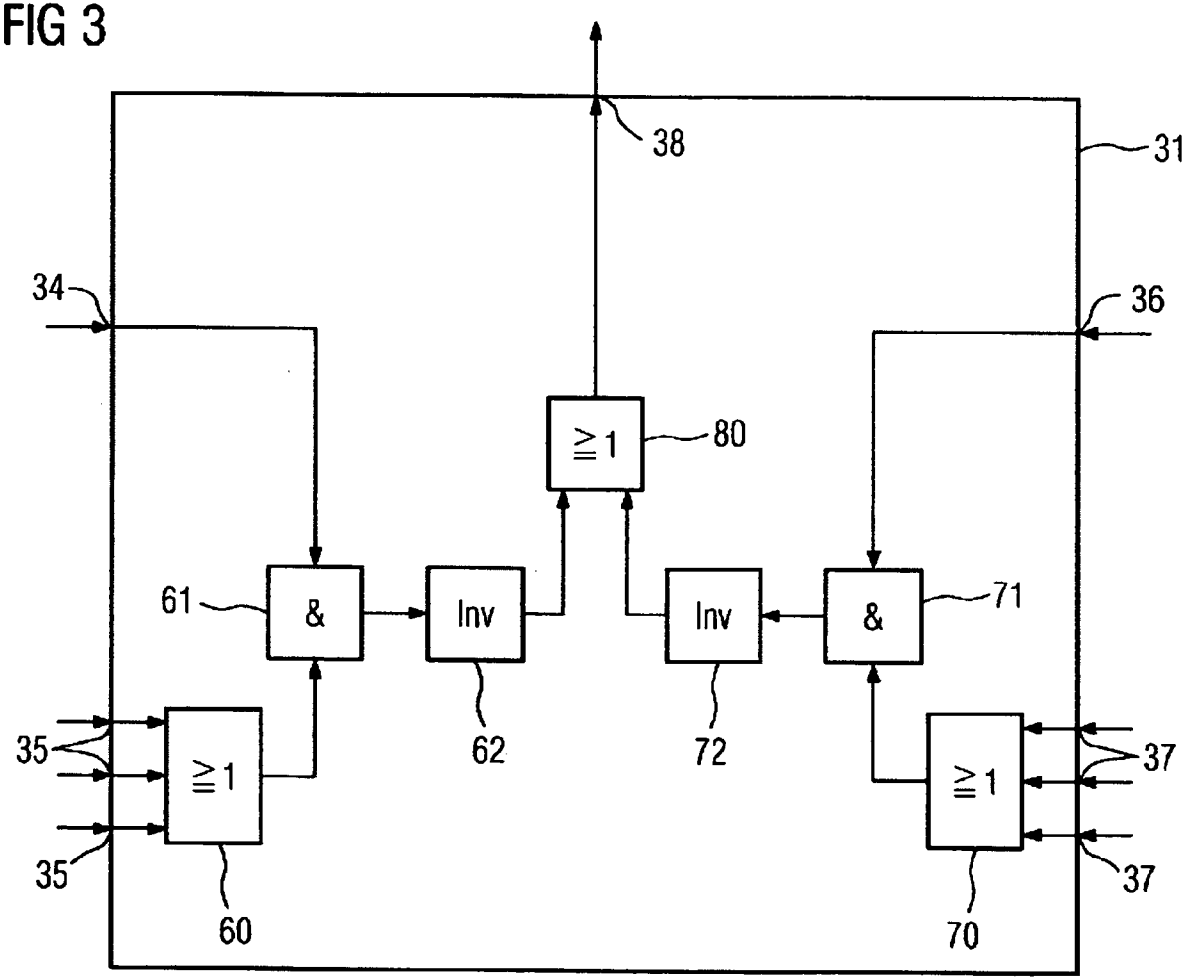
FIG. 3 illustrates a logical linking operation within the error protection circuit.

FIG. 3 shows the described logical link operations in a schematic manner. These linking operations can be extended to take into account further input variables. Changes can be made to adjust to modified incorrect operation situations. In the selected schematic diagram "≧1" means a logical (Boolean) OR operation, "&" means a logical AND operation and "Inv" means a logical inversion (the signal value "1" is inverted to "0" and vice versa).

In one embodiment, the logical signal "1" at the signal input 34 indicates the presence of an x-ray detector. The logical signal "1" at one of the signals inputs 35 indicates the activation of an exposure measurement element assigned to the x-ray detector. As a result of the OR operation 60, the logical signal "1" is then present. The two signals "1" are linked by the AND operation 61 to the logical signal "1." The subsequent inversion 62 gives the logical signal "0" for this half-side of the overall logic.

The logical signal "1" at the signal input 34 indicates the presence of an x-ray detector. However, the logical signal "0" at the signal inputs 35 indicates that none of the exposure measurement elements assigned to the detector have been activated. There is therefore an error situation, where an x-ray detector has been inserted but no associated exposure measurement elements have been activated. The OR operation 70 then results in the logical signal "0." The signals are linked by the AND operation 71 to the logical signal "0." The subsequent inversion 72 gives the logical signal "1" for this half-side of the overall logic.

The logical signal "1" as a result of the inversion 72 results, irrespective of the signal situation of the other half-side of the overall logic, in the OR operation 80 resulting in the logical signal "1." This is generated at the signal output 38 of the error protection circuit 31. The logical signal "1" at the signal output 38 has the same significance as the generation of the deactivation signal by the error protection circuit 31.

The present embodiments can be summarized as follows. The present embodiments relate to an error protection circuit 31 for an x-ray facility. In one exemplary embodiment, the error protection circuit 31 includes at least one input 34, 36, by way of which a detector identification signal of a detector identification element 42, 52 can be received. The detector identification signal characterizing the presence of an x-ray detector. The x-ray facility includes at least one input 35, 37, by way of which a selection signal for an exposure measurement element 45, 46, 47, 55, 56, 57 can be received. The selection signal characterizing the activation of an exposure measurement element 45, 46, 47, 55, 56, 57. A deactivation signal can be emitted by way of at least one output 38 of the error protection circuit 31. The deactivation signal generated on the basis that a detector identification signal and a selection signal assigned to the same detector as the detector identification signal are not received at the same time.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. An error protection circuit for an x-ray facility comprising:

a first input that is operable to receive a detector identification signal of a detector identification element, said detector identification signal characterizing the presence of an x-ray detector, a second input that is operable to receive a selection signal for an exposure measurement element, said selection signal characterizing the activation of the exposure measurement element, and an output that is operable to emit a deactivation signal, the deactivation signal being generated on the basis that a detector identification signal and a selection signal assigned to the x-ray detector as the detector identification signal are not received at the same time.

2. The error protection circuit as claimed in claim 1, wherein the deactivation signal is generated on the basis that a detector identification signal and no selection signal assigned to the same detector as the detector identification signal is received.

3. The error protection circuit as claimed in claim 1 or 2, wherein the deactivation signal is generated on the basis that a selection signal and no detector identification signal assigned to the same detector as the selection signal is received.

4. The error protection circuit as claimed in claim 1, wherein the deactivation signal is received by an x-ray generator.

5. The error protection circuit as claimed in claim 4, wherein the deactivation signal is received by an input of the x-ray generator provided for deactivation signals.

6. The error protection circuit as claimed in claim 1, comprising a plurality of detectors.

7. The error protection circuit as claimed in claim 1, comprising a plurality of inputs operable to receive different detector identification signals of the detector identification element.

8. The error protection circuit as claimed in claim 1, comprising a plurality of inputs operable to receive different selection signals.

9. The error protection circuit as claimed in claim 1, comprising a plurality of outputs operable to emit different deactivation signals.

10. The error protection circuit as claimed in claim 5, wherein the input of the x-ray generator is provided for a door contact signal.

11. An x-ray facility with at least one image receiver, comprising:

at least one detector identification element that is operable to generate a detector identification signal, said signal characterizing the presence of an x-ray detector, and at least one exposure measurement element, which is activated by a selection signal generated by the x-ray facility, and an error protection circuit comprising, a first input that is operable to receive a detector identification signal of a detector identification element, said detector identification signal characterizing the presence of an x-ray detector, a second input that is operable to receive a selection signal for an exposure measurement element, said selection signal characterizing the activation of the exposure measurement element, and an output that is operable to emit a deactivation signal, the deactivation signal being generated on the basis that a detector identification signal and a selection signal assigned to the x-ray detector as the detector identification signal are not received at the same time.

* * * * *